United States Patent [19]

Kasser

[11] 4,409,065

[45] Oct. 11, 1983

[54] KRAFT PAPER

[75] Inventor: Alexander Kasser, Innsbruck, Austria

[73] Assignee: Technopulp A.G., Switzerland

[21] Appl. No.: 48,129

[22] Filed: Jun. 13, 1979

Related U.S. Application Data

[63] Continuation-in-part of Ser. No. 870,235, Jan. 16, 1978, abandoned.

[30] Foreign Application Priority Data

Jan. 26, 1977 [AT] Austria ..... 474/77

[51] Int. Cl.[3] ..... D21D 1/00

[52] U.S. Cl. ..... 162/9; 162/100; 162/231

[58] Field of Search ..... 162/9, 100, 28

[56] References Cited

U.S. PATENT DOCUMENTS 2,516,384 7/1950 Hill et al. ..... 162/100

OTHER PUBLICATIONS

Casey, J. P., "Pulp and Paper", vol. II, Sec. Ed. Interscience Pub. NY, NY, 1960, pp. 743–744.

*Primary Examiner*—William F. Smith

*Attorney, Agent, or Firm*—Karl W. Flocks; Sheridan Neimark

[57] ABSTRACT

Method for the production of kraft paper for increasing its functional quality, particularly its tensile energy absorption, whereby the pulp being prepared in a conventional manner is processed by additional separate curlation directly before web formation for increasing the elastic stretch and a paper bag made of that kraft paper wherein the elastic stretch exceeds 1.8%.

7 Claims, No Drawings

KRAFT PAPER

BACKGROUND OF THE INVENTION

1. FIELD OF THE INVENTION

This is a continuation-in-part of parent, copending application Ser. No. 870,235 filed Jan. 16, 1978 abandoned, the contents of which are hereby incorporated by reference.

The invention relates to a kraft paper and to a process for its production, in particular for packaging materials such as paper bags and the like.

The quality of such kraft paper usually used for the production of paper bags or sacks is mainly determined by its physical properties. A characteristic factor is the tensile energy absorption which is calculated from the product of breaking stress and stretch-to-break. The value of the tensile energy absorption is then related to the functional quality of a kraft paper.

2. DESCRIPTION OF THE PRIOR ART

Kraft paper is conventionally produced by preparing cellulose for the subsequent beating in a pulper, for example. This process already influences the physical properties of the kraft paper to be produced, whereby the breaking length is increased by an increasing degree of beating. This increase is, however, limited by a simultaneous undesirable decrease in paper porosity as air permeability is an important property for paper bags, an undesirable increase in stiffness which causes difficulties in further processing, and an undesirable decrease in tearing resistance.

A further possiblity of increasing the functional quality of kraft paper is to increase the total stretch-to-break-rate $\epsilon_{total}$ of the paper by mechanical shrinkage during its production. When producing dry-finish paper, the paper leaves the paper-machine with a strength of $\epsilon_{total}=2.5\%$ for example, whereas paper can be produced with a stretch of $\epsilon_{total}=8.5\%$ by inserting a shrinking means. This increase of stretch $\epsilon_{total}$ does not, however, cause the increase in the functional quality which should be achieved according to the calculated tensile energy absorption.

It has, therefore, been common up to now to secure the required functional quality of the kraft paper by correspondingly choosing the weight per unit area, taking into consideration the above-mentioned factors when preparing the basic substance and producing the paper as there is a relation between weight per unit area and stretch, and weight per unit area and breaking load, i.e. the tensile energy absorption (T.E.A.), which can be easily determined.

The curling of paper pulp, e.g. using a Kollergang, is in itself known, but conventional processes for the production of papers provide a treatment of pulp in the Kollergang until all the fibers are laid open, after which the desired degree of beating or refining of the pulp is achieved in a bearer or a refiner. In this subsequent beating process the previously produced fiber-curls are largely brushed out again. The curling effect of a curlator is equally known, the curlator, however, being used up to now only for refining pulp of minor quality. This refining process has so far taken place before or simultaneously with the beating process.

SUMMARY OF THE INVENTION

It is, therefore, an object of the present invention to improve functional quality of kraft papers to such an extent that the weight per unit area which has heretofore been required, can be reduced. Important properties, such as porosity and air permeability, are, however, maintained. It is a general object to overcome the deficiencies of the prior art, such as indicated above. Another object is to provide for paper bags of increased strength, without sacrifice of other properties.

According to the invention a method for the production of kraft paper is provided so that the pulp being refined in a conventional manner is processed by carrying out an additional separate curlating treatment directly before web formation for increasing the elastic strength $\epsilon_{el}$ of the dried web to an approximate value exceeding 1.8%.

In a preferred embodiment of the invention the kraft paper is used for producing paper sacks in which the high elastic stretch $\epsilon_{el}$ according to the invention has a particularly favorable effect on the functional quality.

The invention is thus based on the fact that the functional quality of packaging materials of kraft papers increases with an increasing percentage of the elastic stretch $\epsilon_{el}$ in the total stretch-to-break-rate $\epsilon_{total}$. This can be explained by the fact that in practice—which can be simulated in drop-tests—the energy absorbed by the paper is converted into a plastic and an elastic stretch. While the elastic stretch is reversible, the plastic stretch remains and causes a stretch decrease and, thus, a decrease in the tensile energy absorption. This explains why the conventional increase in the total stretch-to-break-rate that is usually achieved by creping does not have the desired positive effect on the functional quality. The increase in the total stretch $\epsilon_{tot}$ achieved by shrinking the finished web shows its effect almost exclusively in the plastic stretch and, thus, represents no actual improvement of the functional quality. On the contrary, in the case of excessive shrinking, it leads to premature disadvantageous deformation of packaging materials, such as sacks and the like. The degree of curl is indicated by the factor $K_F=L_{eff}/L_s$ ($L_{eff}$=actual fiber-length, $L_s$—fiber-length after curling).

DETAILED DESCRIPTION OF EMBODIMENTS

The method according to the invention starts after the conventional refining treatments of the prior art, e.g. treatment in a defibrator, Kollergang, pulp beater, and/or refiner. It is at this point that the prepared and beaten pulp referred to as the refined pulp, undergoes the last additional separate curlation process which is a preferably carried out in a Kollergang or other equipment causing a similar or same effect. In accordance with the invention it has suprisingly been found that the fibers first straightened by the beating process are better suited for the systematical curlation process rather than randomly deformed fibers. Curling the fibers can, however, also be carried out in other types of suitable machines, just as the preparation of fibers before beating can be done in any suitable way.

It is preferably provided that during the separate curlating treatment of fibers, following the conventional refining and/or beating (hereinafter refining), the stock suspension, which has been dewatered, has a fiber content of 20 to 60%. The dewatered pulp should be curled to an average curl factor of 1.15, preferably 1.2. Advantageously the pulp is curled up to an average factor of curl exceeding 1.3.

Water is then added to the separately curled pulp to provide a fiber content of approximately between 0.09% and 0.21% when heavy kraft paper for heavy bags is being made, or no more than 0.02% when light kraft paper for light bags is being made.

The pulp is forwarded to sheet formation immediately after the separate curlation process so that the curl can be maintained to a large extent. Extensive storage of the pulp has to be avoided in order to prevent a restraightening of the fibers.

Just as it is necessary to effect web formation immediately after separate curlation of the pulp, it is also necessary to dry the web in a subsequent preferred step of the process, e.g. in a conventional way, but whereby tension is kept low so that the produced fiber cohesion and the curl of the fibers are maintained to a large extent.

DESCRIPTION OF COMPARATIVE TESTS

In the following further details and advantages of the kraft paper according to the invention and a process for its production are described in detail by means of a number of comparative tests without being limited thereto. The following kraft papers (paper bags produced therefrom) were used in the tests:

| No. | Origin | Abbreviation | No. weight per unit area g/m² | No. | production process |
|---|---|---|---|---|---|
| 1(8) | US, North | US. N | 67 | 83 | prepared according to conventional methods |
| 2(9) | US, South | US. S | 68 | 85 | prepared according to conventional methods |
| 3(10) | Skand. A | SK. A | 70 | 85 | prepared according to conventional methods |
| 4(11) | Skand. B | SK. B | 72 | 84 | dried at low tension |
| 5(12) | LK, EUR. | LK | 69 | 85 | prepared according to conventional methods |
| 6(13) | Skand. C | C | 71 | 86 | prepared according to conventional methods |
| 7(14) | Paper according to the invention | KKS | 65 | 79 | 1. beaten resp. refined<br>2. additionally separately curlated resp. shrinked<br>3. dried at low tension |

The kraft papers of numbers 1 through 6 and 8 through 13 were manufactured in a factory and the kraft papers 7 and 14 according to the invention were manufactured on a Kothen-Rapid-Device.

50 samples of each were tested.

Moreover, existent statistic test results of the types (1-6/8-13) of approximately 500 samples were evaluated and included in the comparison.

Usually kraft paper is characterized by its tensile energy absorption (T.E.A. resp. by its stretch-to-break-rate). The T.E.A. is calculated from the product of a constant, which will not be considered in the following of the breaking stress (P) and the stretch-to-break-rate ($\epsilon_{total}$).

The following characteristic values were measured:

a. Breaking strength according to DIN 53112 b. Longitudinal breaking stress $P_L$kp c. Transversal breaking stress $P_q$kp d. Stretch-to-break-rate ($\epsilon_{total}$) biaxial % f. elastic stretch ($\epsilon_{el.}$) biaxial % h. weight per unit area g/m²

For better illustration of the invention, i.e. the prevailing influence of the elastic stretch $\epsilon_{el.}$ on the functional quality of a kraft paper the new value elastic energy absorption has been introduced (T.E.A.$_{el.}$=P. $\epsilon_{el}$):

The characteristic values which have been measured resp. calculated from the measured values were combined in the following table 1.

TABLE 1

| Nr. | Type Kraft-sack paper a | weight per unit area g/m² b | biaxial $\epsilon_{tot}$ % g | biaxial $\epsilon_{el}$ % h | biaxial breaking stress kp l | T.E.A. kpcm (abs) $(l-g)\left(\frac{m}{b}100\right)$ m | T.E.A. kpcm (rel) $\left(\frac{l \cdot h}{b}100\right)$ n | T.E.A. elastic (rel) o |
|---|---|---|---|---|---|---|---|---|
| 1 | USA, NORTH | 67 | 3.1 | 0.97 | 4.05 | 12.7 | 19.0 | 5.85 |
| 2 | USA, SOUTH | 68 | 2.95 | 0.95 | 3.8 | 11.2 | 16.4 | 5.31 |
| 3 | Skand. A | 70 | 3.55 | 1.02 | 5.65 | 20.0 | 28.5 | 8.23 |
| 4 | Skand. B | 72 | 5.30* | 1.50 | 6.0 | 32.1 | 44.6 | 12.5 |
| 5 | LK Eur. | 69 | 6.5* | 1.70 | 5.2 | 33.5 | 48.5 | 12.8 |
| 6 | Skand. C. | 71 | 5.8 | 1.27 | 5.2 | 30.2 | 42.5 | 9.2 |
| 7 | KKS | 67 | 6.00 | 2.27 | 5.4 | 32.25 | 48.1 | 16.9 |
| 8 | USA, NORTH | 83 | 3.15 | 0.97 | 5.5 | 17.3 | 20.8 | 6.42 |
| 9 | USA, SOUTH | 85 | 3.00 | 0.95 | 5.0 | 15.0 | 17.6 | 5.58 |
| 10 | SKAND. A | 85 | 4.05 | 1.15 | 7.4 | 29.8 | 35.0 | 10.2 |
| 11 | SKAND. B | 84 | 5.36* | 1.50 | 7.5 | 39.7 | 47.2 | 13.3 |
| 12 | LK - Eur. | 83 | 6.5* | 1.70 | 6.35 | 41.3 | 49.7 | 13.0 |
| 13 | Skand. C | 86 | 6.5* | 1.27 | 6.55 | 42.5 | 49.4 | 9.6 |
| 14 | KKS | 82 | 6.00 | 2.27 | 6.6 | 39.7 | 48.7 | 18.2 |

*The values for $\epsilon_{total} > 6.5\%$ were reduced to 6.5% as greater stretch deteriorates the properties of the kraft paper.

The weights per unit area being different, forming, however, a measure for the cost of production and the consumption of material, the absolute and elastic T.E.A. in columns n and o were converted into a weight per unit area of 100 in order to form comparable values.

The evaluation of the table reveals a significant superiority of the elastic stretch of the paper according to the invention (KKS) in the case of both weights per unit area and as a result a far bigger elastic T.E.A. compared with conventional kraft papers.

For the drop tests with filled sacks simulating practical usage multiply paper sacks of conventional kraft papers were manufactured according to common methods.

The following table 2 illustrating the construction of the sack was calculated by means of the characteristic values listed in table 1.

The values in columns h and l were also related to a weight per unit area of 100 so that these values can be compared directly.

The correctness of this result can be seen in the fact that the total T.E.A. of sample 6 (in table 3) surmounts the one of sample 3 by 50% but that the obtainable number of drops being 11. 7 surmounts the actual number of drops of sample 3 only by approximately 15%. Exactly this relation, however, exists between the elastic T.E.A. of samples 3 and 6.

Column i of table 3 particularly stresses the advantage of the kraft paper according to the invention as here the theoretic minimum weight of the individual kraft papers is listed which is necessary to obtain the requested number of drops.

TABLE 2

| No. | Type a | g/m² b | Sack construction: Ply number of type number c | weight per unit area g/m² total d | Total breaking stress Tab 1/l Tab 2/d (Kp) e | $\epsilon_{ges}$ % Tab 1/g mean value f | Total T.E.A. Kpcm (abs) (e · f) g | Total T.E.A. (rel) Kpcm $\left(\frac{g}{d}\ 100\right)$ h | $\epsilon_{el}$ % Tab 1/h mean value i | Total T.E.A. elastic abs. (e · l) k | Total T.E.A. elastic rel. $\left(\frac{K}{d} \cdot 100\right)$ l |
|---|---|---|---|---|---|---|---|---|---|---|---|
| 1 | US. N. | 67 | 3 × 1 + 1 × 8 | 284 | 17.65 | 3.1 | 54.7 | 19.3 | 0.97 | 17.1 | 6.0 |
| 2 | US. S | 68 | 3 × 2 + 1 × 9 | 289 | 16.4 | 3.0 | 49.2 | 17.0 | 0.95 | 15.6 | 5.4 |
| 3 | SK. A | 70 | 3 × 3 | 210 | 16.95 | 3.55 | 60.2 | 28.7 | 1.02 | 17.3 | 8.2 |
| 4 | SK. B | 72 | 3 × 4 | 216 | 18.0 | 5.30 | 95.4 | 44.2 | 1.50 | 27.0 | 1.25 |
| 5 | LK | 69 | 3 × 5 | 207 | 15.5 | 6.5 | 101.4 | 48.9 | 1.70 | 26.5 | 12.8 |
| 6 | SK. C. | 71 | 3 × 6 | 213 | 15.6 | 5.8 | 90.5 | 42.5 | 1.27 | 19.8 | 9.3 |
| 7 | KKS | 67 | 3 × 7 | 201 | 16.2 | 6.0 | 97.2 | 48.3 | 2.27 | 36.7 | 18.2 |
| 8 | US. N. | 83 | 3 × 1 + 2 × 8 | 367 | 23.15 | 3.15 | 72.9 | 19.8 | 0.97 | 22.5 | 6.1 |
| 9 | US. S. | 85 | 3 × 2 + 2 × 9 | 374 | 21.4 | 3.0 | 64.2 | 17.1 | 0.95 | 20.3 | 5.4 |
| 10 | SK. A. | 85 | 3 × 10 | 255 | 22.2 | 4.05 | 89.9 | 35.2 | 1.15 | 25.5 | 10.0 |
| 11 | Sk. B | 84 | 3 × 11 | 252 | 22.5 | 5.30 | 119.25 | 47.3 | 1.50 | 33.7 | 13.3 |
| 12 | LK | 83 | 3 × 12 | 249 | 19.05 | 6.5 | 123.8 | 49.7 | 1.70 | 32.4 | 13.0 |
| 13 | SK. C. | 86 | 3 × 13 | 258 | 19.65 | 6.5 | 127.7 | 49.5 | 1.27 | 24.9 | 9.6 |
| 14 | KKS | 82 | 3 × 14 | 246 | 19.8 | 6.0 | 118.8 | 48.3 | 2.27 | 44.9 | →18.2 |

TABLE 3

| No. | Total g/m² Tab 2/d a | Total (abs.) Tab 2/g b | T.E.A. (rel.) Tab 2/h c | Total T.E.A. (abs.) Tab 2/k d | T.E.A. elast. (rel.) Tab 2/l e | Numbers of drops $\frac{o}{a}$ 100 min. f | effect. g | rel. h | Theoretical Minimum standard weight per unit g/m² $\frac{a \cdot f}{g}$ i | Additional weight per unit area of pos. 1-6 to 7 g/m² k | % l |
|---|---|---|---|---|---|---|---|---|---|---|---|
| 1 | 284 | 54.7 | 19.3 | 17.1 | 6.0 | 9.5 | 9.8 | 3.4 | 275 | 195 | +243 |
| 2 | 289 | 49.2 | 17.0 | 15.6 | 5.4 | 9.5 | 9.8 | 3.3 | 280 | 200 | +250 |
| 3 | 210 | 60.2 | 28.7 | 17.3 | 8.2 | 9.5 | 9.8 | 4.6 | 203 | 123 | +154 |
| 4 | 216 | 95.4 | 44.2 | 27.0 | 12.5 | 9.5 | 17.3 | 8.0 | 118 | 38 | +47.5 |
| 5 | 207 | 101.4 | 48.9 | 26.5 | 12.8 | 9.5 | 18.0 | 8.7 | 109 | 29 | +36 |
| 6 | 213 | 90.5 | 42.5 | 19.8 | 9.3 | 9.5 | 11.7 | 5.5 | 172 | 92 | +115 |
| 7 | 201 | 97.2 | 48.3 | 36.7 | 18.2 | 9.5 | 23.9 | 11.9 | 80 | Differenz i Pos 8-13 to 14 | |
| 8 | 367 | 72.9 | 19.8 | 22.5 | 6.1 | 13.5 | 13.2 | 3.6 | 375 | 295 | +368 |
| 9 | 374 | 64.2 | 17.1 | 20.3 | 5.4 | 13.5 | 13.9 | 3.7 | 363 | 283 | +353 |
| 10 | 255 | 89.9 | 35.2 | 25.5 | 10.0 | 13.5 | 12.1 | 4.8 | 284 | 204 | +255 |
| 11 | 252 | 119.25 | 47.3 | 33.7 | 13.3 | 13.5 | 20.2 | 8.0 | 168 | 88 | +110 |
| 12 | 249 | 123.8 | 49.7 | 32.4 | 13.0 | 13.5 | 21.4 | 8.6 | 157 | 77 | +96 |
| 13 | 258 | 127.7 | 49.5 | 24.9 | 9.6 | 13.5 | 14.4 | 5.6 | 241 | 161 | +201 |
| 14 | 246 | 118.8 | 48.3 | 44.0 | 18.2 | 13.5 | 29.2 | 11.9 | 114 | — | — |

This table shows the practical evaluation of the drop tests with sacks of conventional kraft papers.

Columns f and g show the standard numbers of drops and the actually achieved numbers, which in column h the theoretic numbers of drops are listed as related to a weight per unit area of 100 g/m². As the samples of the paper according to the invention were not sufficient for the production of sacks their number of drops were calculated from the relation between the relative number of drops of comparable samples 4, 5, 11, 2 and the elastic stretch $\epsilon_{el}$. By means of this average factor the expected number of drops for types 7 and 14 were calculated, this number being substantially higher than the one of compared sacks of kraft paper.

Columns k and l show the theoretic additionally required amount of pulp with conventional kraft papers in respect of kraft paper according to the invention having the same functional quality.

As proved by the tests, the functional quality is far better illustrated by the elastic T.E.A.

Use of the economic and technical advantages of the process and paper according to the invention can be made by reducing the weight per unit area and/or by avoiding the bursting of bags which has quite often been caused by dynamic strain.

Finally it has to be pointed out, that curlation can be carried out in many different ways.

It will be obvious to those skilled in the art that various changes may be made without departing from the scope of the invention and therefore the invention is not limited to what is shown in the drawings and described in the specification but only as indicated in the appended claims.

What is claimed is:

1. In a method for the production of kraft paper comprising the steps of preparing the pulp in a conventional manner including beating or refining or treating the pulp in a Kollergang to produce a refined pulp, the improvement for producing kraft paper for heavy paper bags having increased tensile energy absorption and an elastic stretch exceeding 1.8%, comprising dewatering said refined pulp to a water content of substantially 20% to 60%, processing said dewatered pulp by separate curlation to curl the fibers to an average factor of curl exceeding 1.3, dispersing said curled pulp with water to a curled fiber content of approximately 0.09% to 0.21%, promptly forming a wet web from said pulp before the fibers restraighten, and drying the wet web while maintaining low tension so that the curl of the fiber is maintained.

2. In a method for the production of kraft paper comprising the steps of preparing the pulp in a conventional manner including beating or refining or treating the pulp in a Kollergang to produce a refined pulp, the improvement for producing kraft paper for light paper bags having increased tensile energy absorption and an elastic stretch exceeding 1.8%, comprising dewatering said refined pulp to a water content of substantially 20% to 60%, processing said dewatered pulp by separate curlation to curl the fibers to an average factor of curl exceeding 1.3, dispersing said curled pulp with water to a curled fiber content of less than 0.02% promptly forming a wet web from said pulp before the fibers re-straighten, and drying the wet web while maintaining low tension so that the curl of the fibers is maintained.

3. Paper sack made of kraft paper according to claim 1 wherein the elastic stretch exceeds 1.8%.

4. Paper sack made of kraft paper according to claim 2 wherein the elastic stretch exceeds 1.8%.

5. Method according to claim 1 or claim 2 wherein said steps of preparing the pulp in a conventional manner comprises beating or refining the pulp.

6. Method according to claim 1 or claim 2 wherein the steps of preparing the pulp in a conventional manner comprises treating the pulp in a Kollergang.

7. Paper sack according to claim 3 or claim 4 wherein the weight per unit area of the kraft paper is at least 65 $g/m^2$.

* * * * *